US005642822A

United States Patent [19]

Monzen et al.

[11] Patent Number: 5,642,822

[45] Date of Patent: Jul. 1, 1997

[54] SUSPENDED LOAD VIBRATION PREVENTING APPARATUS

[75] Inventors: Tadaaki Monzen; Susumu Kono, both of Tokyo; Yoshiaki Ohkubo, Hiroshima; Toshiyuki Fujii, Hiroshima; Kouji Uchida, Hiroshima, all of Japan

[73] Assignee: Mitsubishi Jukogyo Kabushiki Kaisha, Tokyo, Japan

[21] Appl. No.: 629,090

[22] Filed: Apr. 8, 1996

[30] Foreign Application Priority Data

Apr. 24, 1995 [JP] Japan ..... 7-098239

[51] Int. Cl.[6] ..... B66C 13/06

[52] U.S. Cl. ..... 212/275; 340/685

[58] Field of Search ..... 212/275; 340/685

[56] References Cited

U.S. PATENT DOCUMENTS 5,490,601 2/1996 Heissat et al. ..... 212/275

5,491,549 2/1996 Wichner et al. ..... 212/275

FOREIGN PATENT DOCUMENTS 6-336394 12/1994 Japan .

*Primary Examiner*—Thomas J. Brahan

*Attorney, Agent, or Firm*—Wenderoth, Lind & Ponack

[57] ABSTRACT

A suspended load swaying and vibration preventing apparatus for simultaneously controlling prevention of swaying of a suspended load and suppression of vibration of a structural body is provided in a container crane or the like. A trolley position and a trolley velocity are detected by a trolley position detector and a trolley detector. A swaying shift and a swaying velocity of the suspended load is detected by an image sensor. Furthermore, a shift and a velocity of a structural body is detected by a structural body vibration detector. A controller receives the detection signals from these sections, calculates the optimum trolley velocity based upon a control theory and outputs a trolley velocity command. Then, a trolley drive device is driven in accordance with the trolley velocity command from the controller. The suspended load is delivered to a desired position in a stable manner under the condition that swaying of the suspended load and the vibration of the structural body are suppressed.

9 Claims, 5 Drawing Sheets

SUSPENDED LOAD VIBRATION PREVENTING APPARATUS

BACKGROUND OF THE INVENTION

1. Field of the Invention

The present invention relates to a vibration and sway preventing apparatus for suspended loads in container cranes or the like.

2. Description of the Prior Art

FIG. 4 shows a sway preventing apparatus for suspended loads in a conventional container crane. In FIG. 4, reference numeral 1 denotes a structural body of the crane, reference numeral 2 denotes a trolley that horizontally moves on the structural body 1 (left and right direction in FIG. 4), reference numeral 3 denotes a trolley drive device for horizontally driving the trolley 2, reference numeral 4 denotes drive ropes for tugging the trolley 2, reference numeral 5 denotes a horizontal drum rotated by the trolley drive device 3 for winding the drive rope 4, and reference numeral 6 denotes a suspended load to be delivered.

First of all, an explanation will be made as to the swaying of the suspended load. In the case where the trolley 2 is moved laterally or horizontally from left to right in the condition shown in FIG. 4, when the trolley 2 is accelerated, the suspended load 6 is moved to the left side of FIG. 4 by an inertia force. Then, after the trolley 2 has been moved through a predetermined distance, when the trolley 2 is decelerated, the suspended load 6 is swung forwardly at the right side in FIG. 4 by the inertia force unlike the acceleration of the suspended load 6. The conventional sway preventing apparatus copes with the problem of the swaying of the suspended load 6 as follows. A moving position of a mark 8 on a suspension tool 7 is recognized by an image sensor 9 mounted on a bottom surface of the trolley 2 so that a swaying shift and a swaying velocity of the suspended load 6 are detected. The position and the velocity of the trolley 2 are detected by a trolley position sensor 10 and a trolley velocity detector 11 provided in the trolley drive device 3. At the same time, swaying parameters (swaying shift and swaying velocity) of the suspended load 6 thus detected and motion parameters (trolley position and trolley velocity) of the trolley horizontal movement are input into a controller 12. On the basis of these motion parameters, the trolley velocity is calculated and a trolley velocity command is output to the trolley drive device 3.

As a result, the trolley drive device 3 is driven in accordance with the trolley velocity command, so that the sway preventing control is carried out for the suspended load 6. FIG. 5 is a block diagram showing a process for these steps.

As described above, in the conventional suspended load sway preventing apparatus, the trolley velocity is calculated from the suspended load swaying motion parameters and the motion parameters of the trolley horizontal movement so that the swaying preventing control of the suspended load 6 is carried out. However, there is no control to prevent vibration of the structural body 1, generated in accordance with the horizontal movement of the trolley 2.

The lateral movement of the trolley 2 also causes the structural body 1 to vibrate in addition to the swaying of the suspended load 6. The vibration of the structural body 1 will be explained. In the case where the trolley 2 is moved from left to right, the trolley drive device 3 tugs the trolley 2 in the right direction by driving the horizontal drum 5 in the direction in which the drive ropes 4 are wound. Then, a tension of each drive rope 4 on the right side is increased by the inertia force of the trolley 2 which tends to stop. On the other hand, the tension of the drive rope 4 on the left side is kept constant by each rope tensioner 13. For this reason, a tension difference is generated between the right and left sides of the drive rope 4. This tension difference is applied through the horizontal drum 5 to the trolley drive device 3 fixed to the structural body 1, so that the structural body 1 is tensed to the right on the high tension side and is twisted to the right. As a result, a natural frequency of the structural body 1 is excited to generate the vibration.

Then, in the case where the trolley 2 is stopped, the rotational speed of the horizontal drum 5 is decreased. However, since the trolley 2 tends to continue the horizontal movement in the right direction by the inertia force, the tension of the drive rope 4 on the right side is decreased. On the other hand, the tension of the drive rope 4 on the left side is kept constant by the rope tensioner 13. For this reason, a tension difference is generated on the opposite side to that generated during the acceleration as described above. By the tension difference, the structural body 1 is tugged on the left side where the tension is stronger. The body 1 is twisted in the left side. A natural frequency of the structural body 1 is excited to generate the vibration.

As described above, in the conventional suspended load sway preventing apparatus, since the vibration control is not applied to the vibration of the structural body 1, the conventional apparatus suffers from the following problems:

(1) The natural frequency cycle of vibration of the structural body 1 is short so that vibratory shift is small but the acceleration is large. Thus, the driver of the trolley is impressed with an unsatisfactory feeling.

(2) At some timing of the horizontal acceleration/deceleration of the trolley 2, the vibration of the structural body is amplified. Accordingly, there is a problem with respect to the fatigue strength of the structural body.

SUMMARY OF THE INVENTION

Accordingly, in view of the above-noted defects inherent in the conventional apparatus, according to the present invention, there is provided a suspended load vibration preventing apparatus for simultaneously controlling prevention of swaying of a suspended load and suppression of vibration of a structural body in a container crane or the like.

In a suspended load swaying and vibration preventing apparatus in which a trolley is horizontally moved by a trolley drive device provided on a crane, a suspended load is suspended by ropes suspended from the trolley, and the trolley is moved for delivery of the suspended load, the suspended load vibration preventing apparatus is characterized by comprising:

- a trolley detector for detecting motion parameters of a trolley horizontal movement;
- an image sensor for detecting motion parameters of swaying of the suspended load;
- a structural body vibration detector for detecting motion parameters of vibration of a crane structural body; and
- a controller for calculating a trolley velocity in accordance with detection signals from the trolley detector, the image sensor and the structural body vibration detector and for outputting a velocity command to the trolley drive device.

The trolley detector for detecting the motion parameters of the trolley horizontal movement comprises a trolley position detector for detecting a position of the trolley and a trolley velocity detector for detecting a velocity of the trolley.

A swaying shift of the suspended load and a swaying velocity of the suspended load are detected by the image sensor for detecting the motion parameters of swaying of the suspended load.

The structural body vibration detector for detecting the motion parameters of the crane structural body comprises an acceleration meter, a velocity inferential device and a shift inferential device for detecting a velocity of the structural body and a shift of the structural body.

With such a suspended load swaying and vibration preventing apparatus according to the present invention, the motion parameters (trolley position and trolley velocity) of the trolley horizontal movement are detected by the trolley detector (trolley position detector and trolley velocity detector), the motion parameters (swaying shift and swaying velocity) of swaying of the suspended load are detected by an image sensor, and furthermore, the motion parameters (shift and velocity of the structural body) of vibration of the crane structural body are detected by the structural body vibration detector (acceleration meter, velocity inferential device and shift inferential device). The controller receives the motion parameters detected by the detectors, calculates the optimum trolley velocity on the basis of the control theory, and outputs the velocity command. As a result, the trolley drive device is driven in accordance with the trolley drive command from the controller. The horizontal movement of the trolley is controlled. Thus, it is possible to deliver the suspended load to a desired position in a stable manner under the condition that the swaying of the suspended load and the vibration of the structural body are suppressed.

DESCRIPTION OF THE PREFERRED EMBODIMENTS

Figure 1:
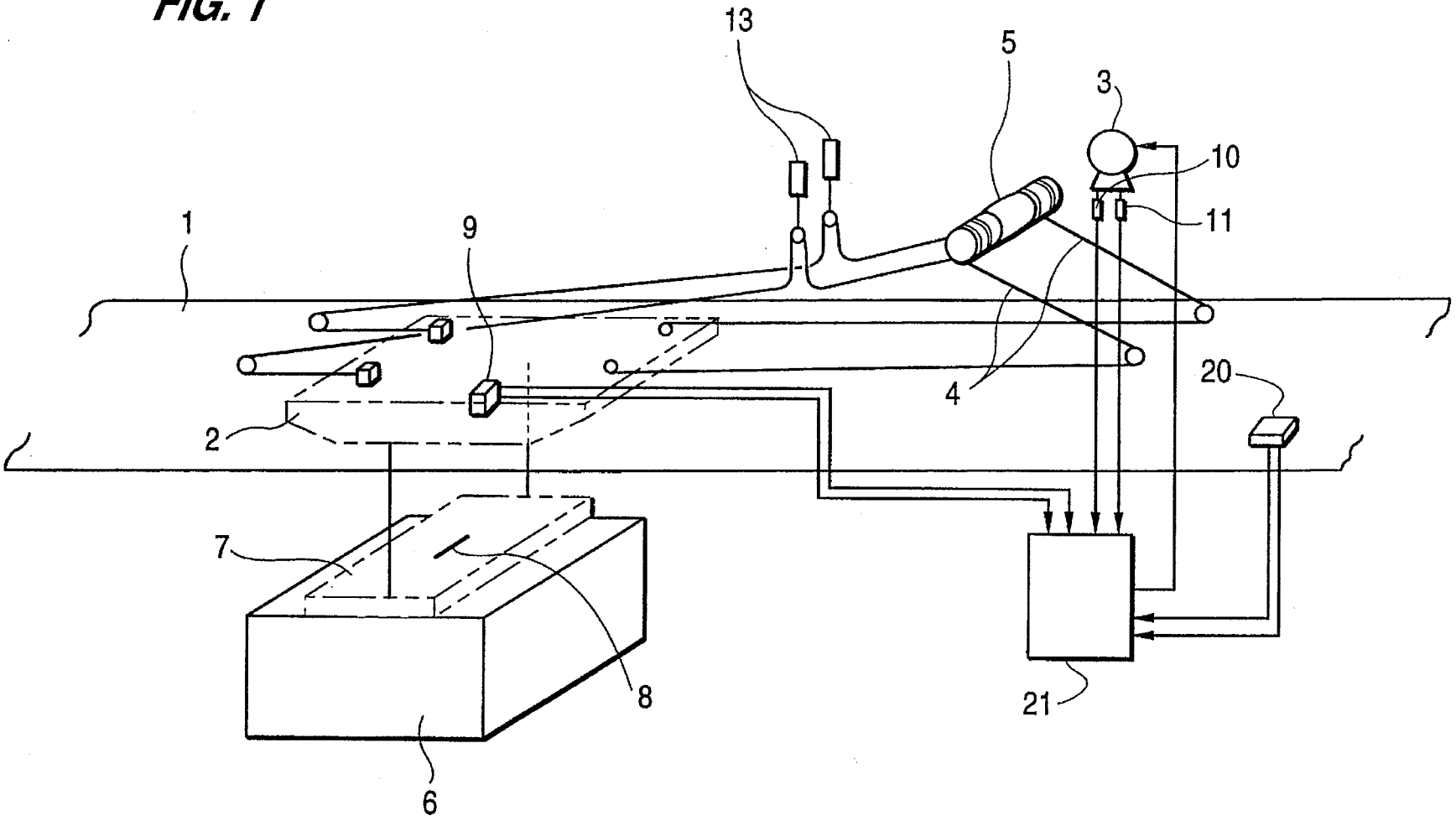
FIG. 1 is a perspective schematic view of a suspended load swaying and vibration preventing apparatus according to one embodiment of the invention.
Figure 2:
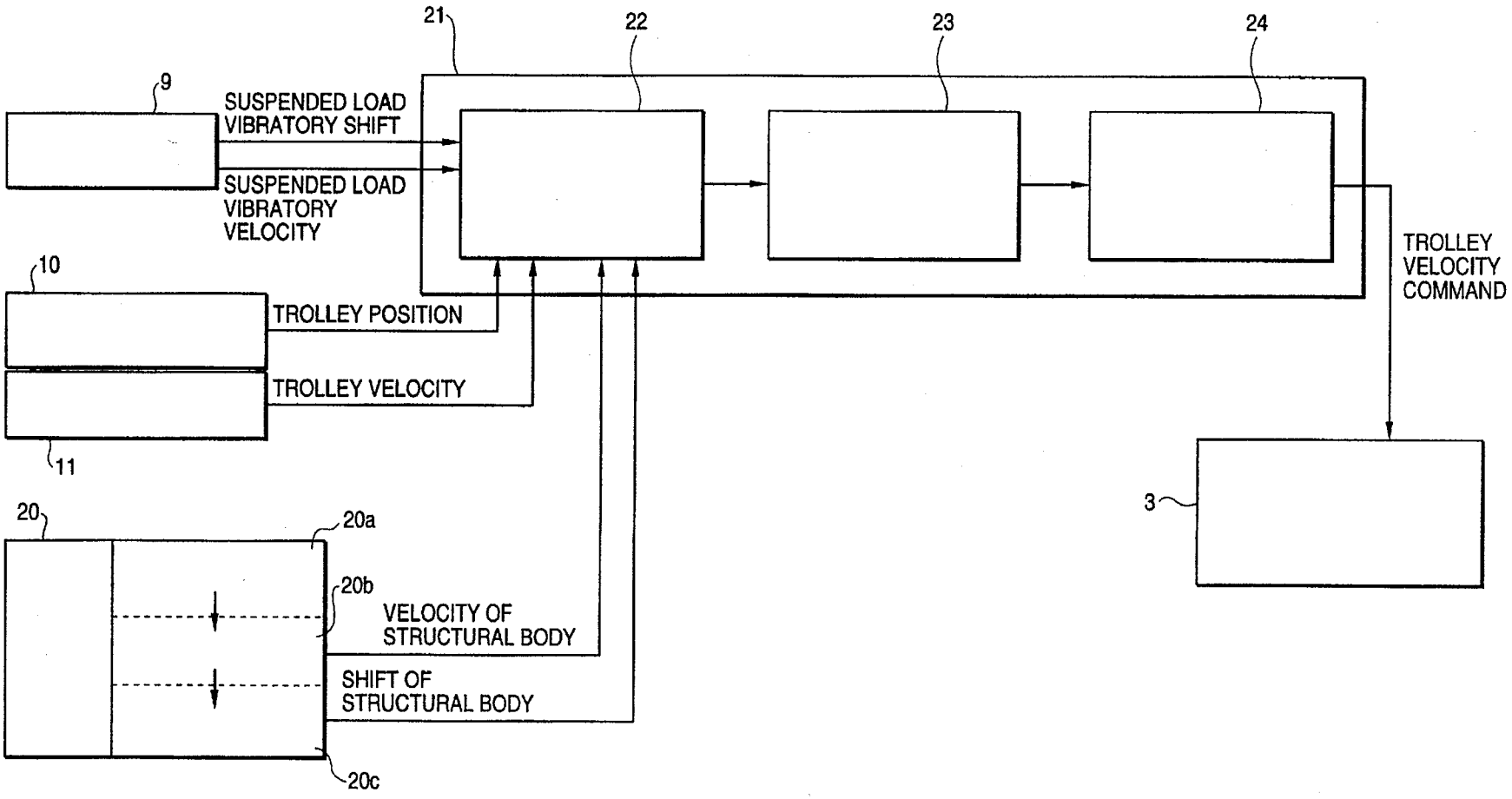
FIG. 2 is a process block diagram of the suspended load swaying and vibration preventing apparatus shown in FIG. 1.
Figure 3:
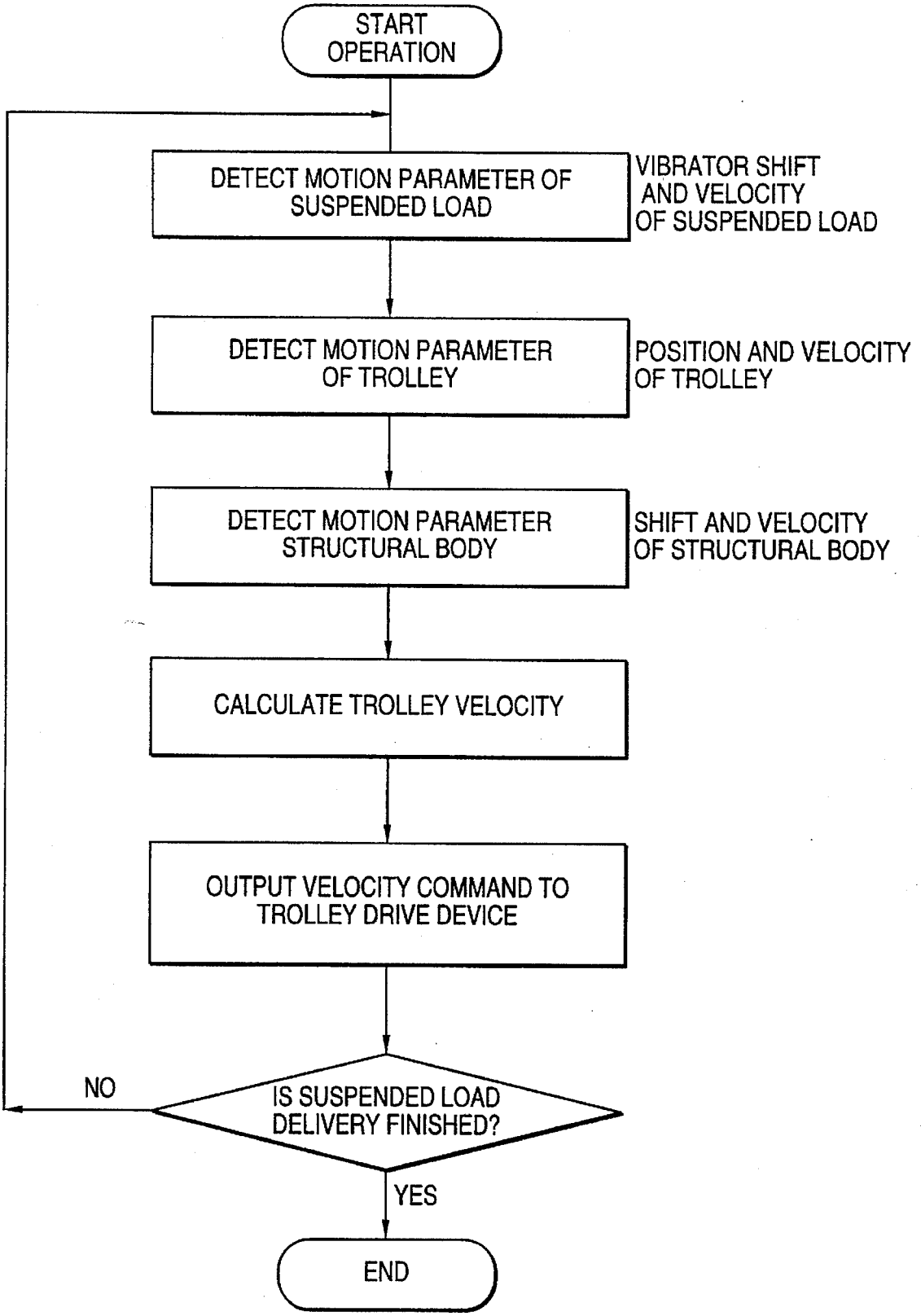
FIG. 3 is a process flowchart for the suspended load swaying and vibration preventing apparatus shown in FIG. 1.
Figure 4:
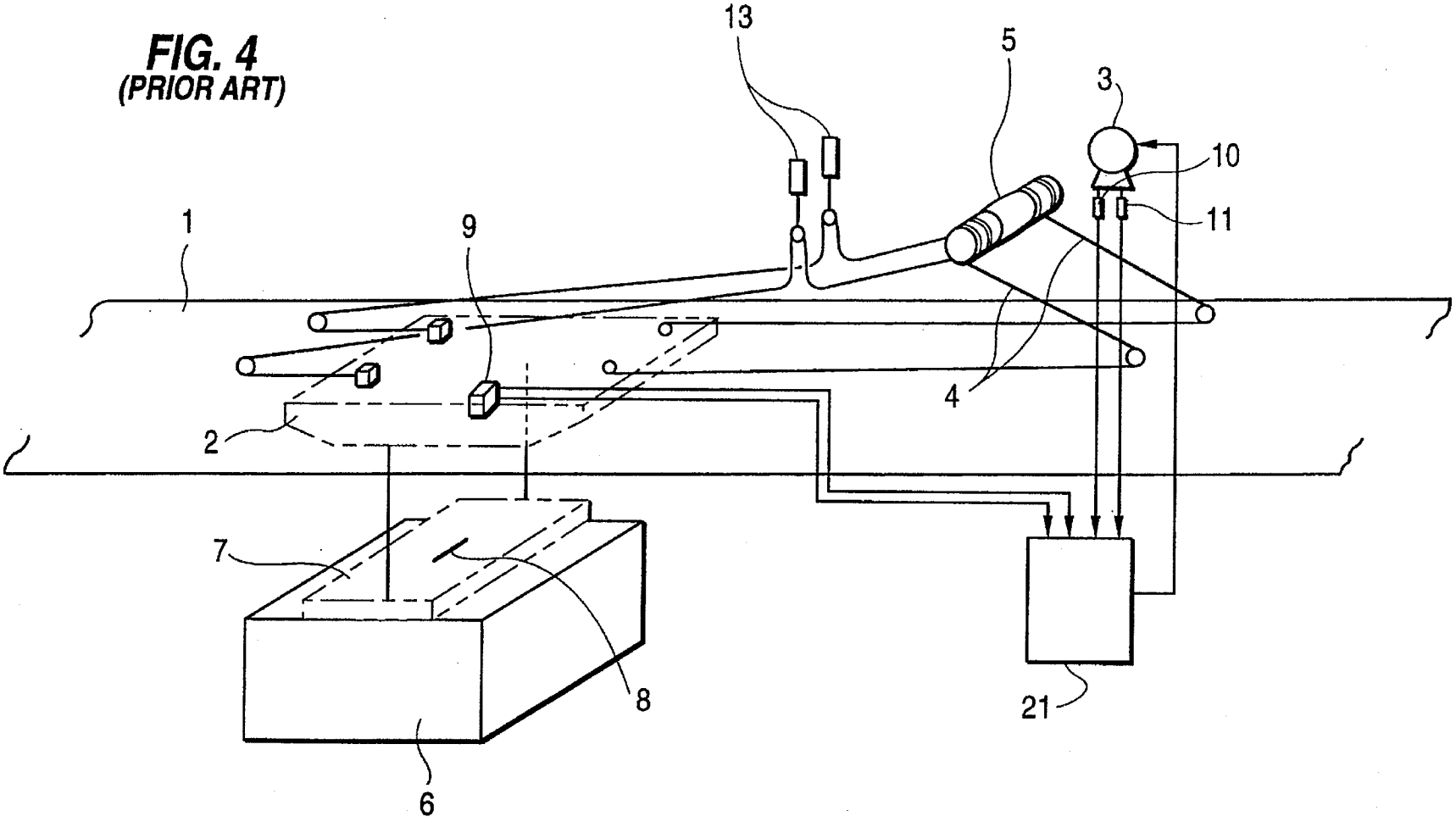
FIG. 4 (PRIOR ART)
FIG. 4 is a perspective schematic view of a conventional suspended load sway preventing apparatus.
Figure 5:
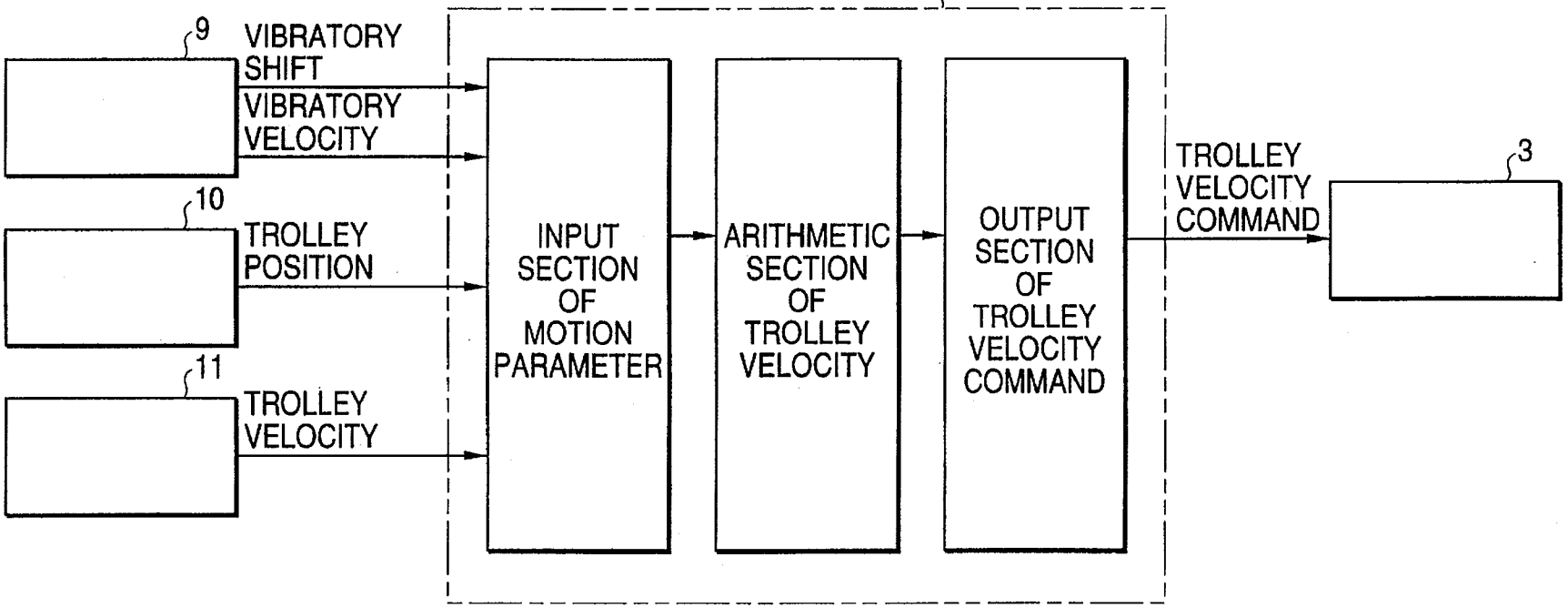
FIG. 5 (PRIOR ART)
FIG. 5 is a process block diagram of the suspended load sway preventing apparatus shown in FIG. 4.

A suspended load swaying and vibration preventing apparatus according to one embodiment of the invention will now be described with reference to FIGS. 1 to 3. FIG. 1 is a perspective schematic view showing the suspended load swaying and vibration preventing apparatus according to the embodiment of the invention. FIG. 2 is a process block diagram and FIG. 3 is a process flowchart. Incidentally, in FIG. 1 to 3, the same reference numerals are used to denote the same members or components as in the conventional apparatus shown in FIG. 4. Therefore, to avoid duplication, the same explanation for the same members and components will be omitted.

In the suspended load swaying and vibration preventing apparatus, the motion parameter of the structural body vibration is further detected in addition to the motion parameter of swaying of the suspended load and the motion parameter of the trolley horizontal movement. These motion parameters are read in the controller for simultaneously controlling the prevention of swaying of the suspended load and the suppression of vibration of the structural body.

In FIG. 1, reference numeral 9 denotes an image sensor provided on a bottom surface of a trolley 2. The image sensor 9 is disposed for recognizing a mark 8 provided on a top surface of a suspension tool 7 to detect a shift and a velocity of swaying of the suspended load. Reference numeral 10 denotes a trolley position detector for detecting the position of the trolley 2. Reference numeral 11 denotes a trolley velocity detector for detecting a velocity of the trolley 2. Both detectors are provided on a trolley drive device 3. Reference numeral 20 denotes a structural body vibration detector for detecting the vibration of the structural body load disposed on the structural body 1.

As shown in FIG. 2, the structural body vibration detector 20 is composed, in combination, of an acceleration meter 20*a*, a velocity inferential device 20*b* and a shift inferential device 20*c*. For instance, the velocity inferential device 20*b* and the shift inferential device 20*c* are each composed of an integrator and a filter for receiving an acceleration signal from the acceleration meter 20*a* and inferring the velocity and for inferring the shift from the inferential velocity.

The motion parameters (swaying shift and swaying velocity) of swaying of the suspended load, the motion parameters (trolley position and trolley velocity) of the horizontal movement of the trolley and the motion parameters (shift and velocity of the structural body) of vibration of the structural body, which have been detected by the respective detectors are fed out to the controller 21.

The controller 21 receives a plurality (six) of detected signals from the above-described respective detectors. The controller 21 processes the signals in accordance with the process block diagram shown in FIG. 2 and the process flowchart shown in FIG. 3 and outputs the trolley velocity command to simultaneously perform the suppression of swaying of the suspended load 6 and the control of vibration of the structural body 1.

Namely, first of all, the controller 21 receives the plurality (six) of detection signals through a motion parameter input section 22 and outputs the detection signals to an arithmetic section 23 for the trolley velocity. The trolley velocity arithmetic section 23 computes the trolley velocity in accordance with a calculation formula (1) given as follows. The calculation result is outputted to an output section 24 for the trolley velocity command. Then, the output section 24 for the trolley velocity command outputs the trolley velocity command to the trolley drive device 3 to drive the trolley 2.

$$u=k1\cdot x1+k2\cdot v1+k3\cdot x2+k4\cdot v2+k5\cdot x3+k6\cdot v3 \quad (1)$$

where u is the trolley velocity command, k1 to k6 are constants, x1 is the swaying shift, v1 is the swaying velocity, x2 is the trolley position, v2 is the trolley velocity, x3 is the structural body shift and v3 is the structural body velocity.

The constants k1 to k6 in the formula are optimum gains such that, for example, on the basis of the optimum control theory, the swaying of the suspended load 6 is rapidly converged, the trolley 2 rapidly reaches a target level and the vibration of the structural body 1 is rapidly converged.

Incidentally, the suppression of vibration of the structural body 1 is carried out by the trolley velocity component calculated in accordance with "k5·x3+k6·v3" in the formula above. The calculation is carried out as follows. For example, when the structural body 1 is shifted to the left in FIG. 1, the trolley 2 is moved in the right direction so that the rope tension on the right side is increased and the force in the right direction is applied to the structural body 1.

As described above, according to the suspended load swaying and vibration preventing apparatus of the present embodiment, in addition to the conventional detection of the motion parameters, the motion parameters of vibration of the structural body are detected and added to the control elements so that it is possible to simultaneously control the suppression of swaying of the suspended load and the suppression of vibration of the structural body in the optimum condition. Accordingly, it is possible to deliver the suspended load to a desired position in a stable manner under the condition that the swaying of the suspended load 6 and the vibration of the structural body 1 be suppressed. In addition, it is possible to reduce a bad feeling of the trolley operator. Also, it is possible to prevent any adverse effect to the structural body fatigue strength caused by the amplification of vibration of the structural body. As a result, it is possible to improve a safety aspect of the structural body.

As described above by way of example, the suspended load swaying and vibration preventing apparatus according to the present invention is provided with the trolley detector for detecting the motion parameters of the trolley horizontal movement, the image sensor for detecting the motion parameters of swaying of the suspended load, the structural body vibration detector for detecting the motion parameters of vibration of the crane structural body, and the controller for calculating the trolley velocity in accordance with the detection signals of the trolley detector, the image sensor and the structural body vibration detector and outputting the velocity command to the trolley drive device. It is therefore possible to simultaneously control the prevention of swaying of the suspended load and the suppression of vibration of the structural body. For this reason, it is possible to deliver the suspended load to a desired position in a stable manner, and in addition, to reduce the bad feeling of the trolley operator due to the vibration of the structural body. Also, it is possible to prevent any adverse effect to the structural body fatigue strength caused by the amplification of vibration of the structural body to improve a safety aspect of the structural body to contribute to the development of the industry.

Various details of the invention may be changed without departing from its spirit and its scope. Furthermore, the foregoing description of the embodiments according to the present invention is provided for the purpose of illustration only, and not for the purpose of limiting the invention as defined by the appended claims and their equivalents.

What we claim is:

1. A suspended load swaying and vibration preventing apparatus for use with a crane having a structural body, a trolley horizontally movably mounted on the structural body, a trolley drive device for moving the trolley relative to the structural body and a load suspended from the trolley by ropes, said suspended load swaying and vibration preventing apparatus comprising:

a trolley detector for detecting motion parameters of horizontal movement of the trolley, an image sensor for detecting motion parameters of swaying of the suspended load;

a structural body vibration detector for detecting motion parameters of vibration of the structural body; and a controller for calculating a trolley velocity in accordance with detection signals from said trolley detector, said image sensor and said structural body vibration detector and for outputting a velocity command to the trolley drive device.

2. The suspended load swaying and vibration preventing apparatus according to claim 1, wherein said trolley detector for detecting the motion parameters of the horizontal movement of the trolley comprises a trolley position detector for detecting a position of the trolley and a trolley velocity detector for detecting a velocity of the trolley.

3. The suspended load swaying and vibration preventing apparatus according to claim 1, wherein said image sensor is operable to detect the motion parameters of vibration of the suspended load by detecting a vibratory shift of the suspended load and a vibratory velocity of the suspended load.

4. The suspended load swaying and vibration preventing apparatus according to claim 1, wherein said structural body vibration detector for detecting the motion parameters of the crane structural body comprises an acceleration meter, a velocity inferential device and a shift inferential device for detecting a velocity of the structural body and a shift of the structural body.

5. The suspended load swaying and vibration preventing apparatus according to claim 4, wherein said trolley detector for detecting the motion parameters of the horizontal movement of the trolley comprises a trolley position detector for detecting a position of the trolley and a trolley velocity detector for detecting a velocity of the trolley.

6. The suspended load swaying and vibration preventing apparatus according to claim 4, wherein said image sensor is operable to detect the motion parameters of vibration of the suspended load by detecting a vibratory shift of the suspended load and a vibratory velocity of the suspended load.

7. The suspended load swaying and vibration preventing apparatus according to claim 1, wherein said structural body vibration detector comprises a velocity detecting means for detecting a velocity of the structural body, and a shift detecting means for detecting a shift of the structural body.

8. The suspended load swaying and vibration preventing apparatus according to claim 7, wherein said trolley detector for detecting the motion parameters of the horizontal movement of the trolley comprises a trolley position detector for detecting a position of the trolley and a trolley velocity detector for detecting a velocity of the trolley.

9. The suspended load swaying and vibration preventing apparatus according to claim 7, wherein said image sensor is operable to detect the motion parameters of vibration of the suspended load by detecting a vibratory shift of the suspended load and a vibratory velocity of the suspended load.

* * * * *